United States Patent [19]

Fourne et al.

[11] 4,141,115

[45] Feb. 27, 1979

[54] METHOD AND APPARATUS FOR CUTTING TEXTILE TOW INTO STAPLE

[76] Inventors: Franz Fourne; Ursula Fourne, both of Kiefernweg 30, D-5300 Bonn, Fed. Rep. of Germany

[21] Appl. No.: 762,282

[22] Filed: Jan. 25, 1977

Related U.S. Application Data

[63] Continuation of Ser. No. 622,506, Oct. 15, 1975, abandoned.

[30] Foreign Application Priority Data

Dec. 2, 1974 [DE] Fed. Rep. of Germany ..... 2456941

[51] Int. Cl.[2] ..... D01G 1/04

[52] U.S. Cl. ..... 19/.6; 83/337; 83/913

[58] Field of Search ..... 19/.3, .58, .6, .62; 83/66, 67, 337, 338, 913

[56] References Cited

U.S. PATENT DOCUMENTS

| | | | |
|---|---|---|---|
| 2,791,274 | 5/1957 | Rivers, Jr. | 83/337 X |
| 3,744,361 | 7/1973 | Van Doorn et al. | 83/67 X |
| 3,930,285 | 1/1976 | Wornall | 19/.56 |
| 3,948,127 | 4/1976 | Vehling et al. | 83/913 |

FOREIGN PATENT DOCUMENTS

| | | | |
|---|---|---|---|
| 129112 | 7/1932 | Austria | 83/337 |
| 531574 | 1/1973 | Switzerland | 19/.6 |

*Primary Examiner*—Dorsey Newton
*Attorney, Agent, or Firm*—Irons and Sears

[57] ABSTRACT

A process and apparatus for cutting textile tow into staple is disclosed. The textile tow is wound onto a textile tow support which is rotatable at a predetermined angular velocity. A plurality of moveable cutting surfaces are attached integrally to the textile tow support around its periphery to permit the tow to be wrapped in surface contact with the cutting surfaces. The tow is cut into staple by transverse or orthogonal movement of the cutting surfaces with respect to the direction of winding of the textile tow on the textile tow support. In a first embodiment of the invention, the cutting surfaces comprise knife bands which are driven by rotation of the textile tow support. In the second embodiment, the cutting surfaces comprise reciprocating knives which are driven by rotation of the textile tow support.

25 Claims, 10 Drawing Figures

METHOD AND APPARATUS FOR CUTTING TEXTILE TOW INTO STAPLE

This is a continuation, of application Ser. No. 622,506, filed 15 Oct. 1975, now abandoned.

BACKGROUND OF THE INVENTION

1. Field of the Invention

The invention relates to textile tow cutting processes and apparatus. More particularly, the invention relates to tow cutting processes and apparatus which perform the cutting by transverse or orthogonal movement of a cutting surface with respect to the direction of wrapping of textile tow on a textile tow support.

2. Description of the Prior Art

Several processes are currently used for continuously cutting textile tow into staple of primarily uniform lengths or into a specific distribution of staple lengths. These processes are unsatisfactory either because of the short life of the cutting surfaces or the nonuniform staple lengths produced thereby.

A well known process for cutting tow, known as the "Gru-Gru System", is described in German Pat. No. 665,939. In this machine the tow is held between two rubber coated slotted wheels while knives affixed on a knife head pass through the slots so that the two is cut into staple in the slots by the shearing effect of the knives.

In another process, tow is introduced through the axis of a rotating wheel and is transported radially outward from the axis of the wheel through a tube into the path of a cutting knife affixed to the wheel at its outer circumference. The cutting of tow is produced by shearing between the cutting knife carried by the rotating wheel and a stationary knife affixed outside the circumference of the wheel in close proximity to the path of the rotating cutting knife. Cutting of the staple produces crushing of the fiber portions of the tow.

Another process cuts tow into staple by transporting tow to a cutting zone where cutting is produced by a rotating disk knife. The tow is carried into one of the slots of a slotted guide disk by means of an aspirator and transported by the disk to the rotating disk knife where the tow is cut into staple and removed by a second aspirator. During cutting, the tow is not held on both sides of the rotating disk knife so that it is partially pushed sideways during cutting which causes nonuniform staple lengths.

Another type of tow cutting machine is described in U.S. Pat. Nos. 3,485,120 and 3,503,100. In this machine, tow cutting into staple is performed by a wheel which consists of a plurality of radially outward pointing stationary knives which are fixedly connected to a pair of disks. The tow cut by the force exerted on the tow by a pressure roll which rides against the outermost layer of tow which is wound over the surface of the knives. After the layers of tow attain a certain thickness, the pressure roll presses with sufficient force against the outside layer of the tow to cause the knife edges to shear the innermost layer of tow at its points of contact with the knives. The cut staple is forced radially inward from surface contact with the knives to a collection point located at the center of the disks from which it is transported away. Continuously, new layers of the tow originating from the outside come in contact with the knives and are cut. This machine differs substantially from the present invention in that cutting of the tow is accomplished by static pressure between the cutting surface of the knives and the tow. Unlike the dynamic cutting of the present invention, the resultant stationary cutting is accomplished by high frictional forces which enhance dulling of the knives and fusing of the staple ends.

U.S. Pat. No. 3,768,355 discloses a tow cutting apparatus in which cutting is performed by stationary knives which are radially or axially disposed with respect to a cylindrical mounting frame. The tow is fed radially against or axially against the respective stationary radially or axially disposed cutting surfaces of the knives. The apparatus disclosed in U.S. Pat. No. 3,768,355 differs from the present invention in that it cuts tow by static pressure between the cutting surface of the knives and the tow.

Those machines using stationary cutting knives have the disadvantage of crushing the tow filaments during cutting which causes a concomitant rapid dulling of cutting surfaces of the knives because of the action of high frictional forces. Cutting of tow with dull knives produces unacceptable staple because of gluing together of the cut fiber ends as a result of the heating of the fibers during cutting by the high frictional forces and also results in staple of multiple lengths when some of the cutting knives are not sharp enough to completely sever the tow. Multiple length staple when processed results in unacceptable yarn products. The presence of multiple length staple is presently eliminated by replacement of the knives after short periods of time. It has been found that replacement of the knives in the prior art apparatus is required after two to four hours of operation with remounting times from twenty minutes to one hour being necessary.

Those prior art machines having moving cutting knives produce a draw cut of the tow between the rapidly rotating cutting knives and the tow. Because of the fact that the tow is not supported on both sides of the cutting knives during cutting, portions of the tow are pulled axially with respect to the axis of the tow which results in uneven staple lengths.

Other machines were developed wherein one or more rotary knife plates are moved vertically through the tow filaments to execute a draw cut between the rapidly moving knives and the tow. In one of these machines, rotating knife disks arranged in the shape of a star cut the tow into staple. In this machine the tow is suspended between two link changes having rubber coated surfaces. The rotating knives cut the tow through the spaces in the link chains. The knives in this machine do not have the disadvantage of a short cutting life found in the other well known apparatus for cutting tow. However, its complex construction has militated against its widespread use.

SUMMARY OF THE INVENTION

A tow cutter constructed according to the present invention comprises a plurality of moveable knives or knife bands which are disposed around the periphery of a rotatable tow support at even or intentionally different spacings. The tow support is comprised of a disk and a ring which are spaced apart a fixed distance by a plurality of mechanical members and knives or knife bands which are moveably supported by the disk and ring to permit their orthogonal or transverse movement with respect to the direction of the winding of the two on the tow support. The tow is wound on the periphery of the tow support in surface contact with the knives or knife bands. Cutting of the tow into staple is produced at the points of contact of the tow with the knives or knife bands by the transverse or orthogonal movement of knives or knife bands.

The terminology "transverse" in terms of the specification and appended claims is defined as all directional orientations except an orientation parallel to a reference line.

DESCRIPTION OF THE PREFERRED EMBODIMENTS

Figure 1:
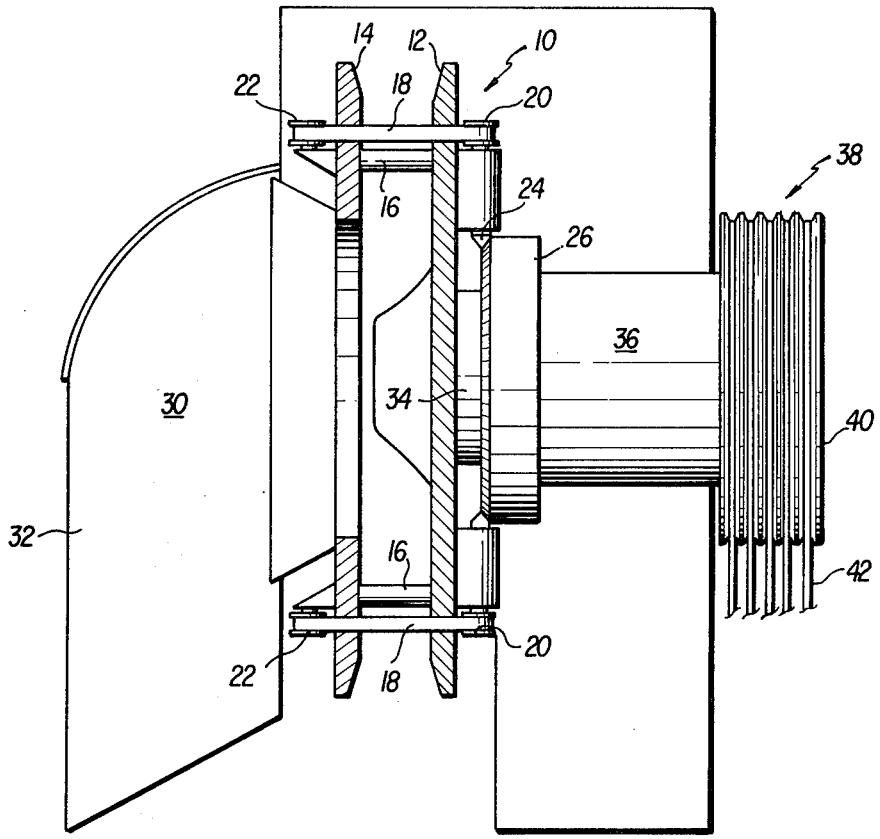
FIG. 1 is a side sectional view of the first embodiment of the present invention.
Figure 2:
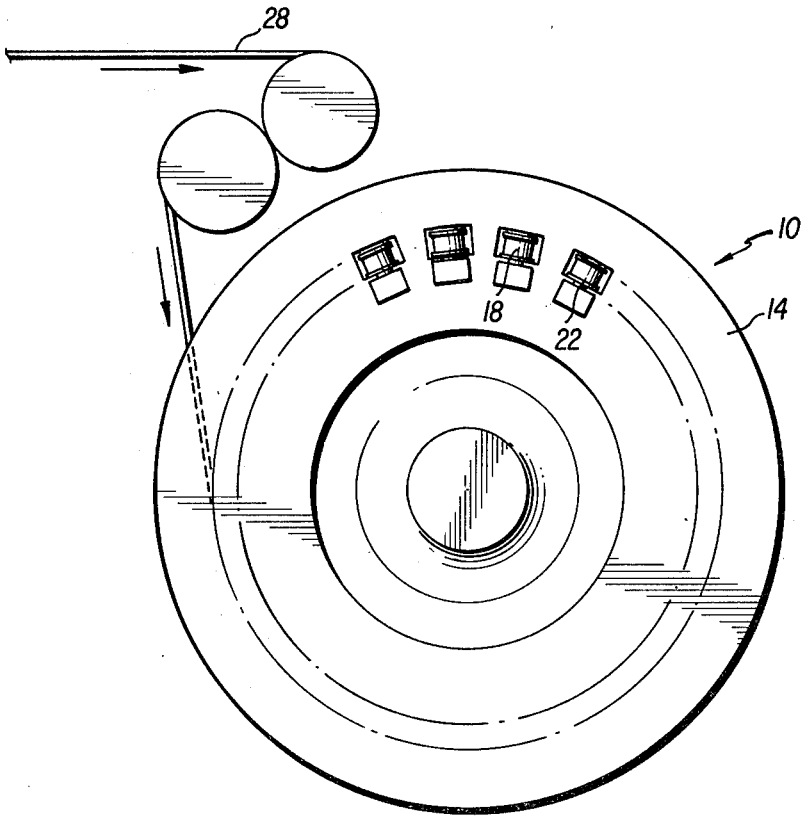
FIG. 2 is an end view of the first embodiment of the present invention.

FIGS. 1 and 2 illustrate the first embodiment of a tow cutting apparatus constructed according to the present invention. A rotatable tow support 10 is provided which is comprised of disk 12 and ring 14 which are spaced apart by mechanical members 16 that are preferably bolts and a plurality of knife bands 18 which are disposed at evenly displaced points around the periphery of the tow support 10. Each knife band 18 is rotatably supported by a pair of band wheels 20 and 22 which are respectively attached to disk 12 and ring 14. When it is desired to cut staple of a single uniform length, the diameter of band wheels 20 and 22 is designed to be equal to the spacing between knife bands, and the diameter of the band wheels is chosen to be contained in the circumference of the tow support 10 an integer number of times. Each band wheel 20 is driven by a shaft (not shown) to which is attached a pinion gear 24. The pinion gear 24 meshes with a stationary ring gear 26. Rotation of the tow support 10 drives the band wheels 20 at an angular velocity which is determined by the gear ratio between pinion gears 24 and ring gear 26. The selection of gear ratio between pinion gear 24 and ring gear 26 permits the velocity of the knife bands 18 to be chosen to be a large multiple of the velocity of the tow support 10 to produce effective cutting of tow 28. Each knife band 18 has two cutting surfaces which move in opposite directions with respect to each other. The tension increase exerted on the tow 28 caused by opposite direction movement of adjacent cutting surfaces of the knife bands 18 improves cutting. The band wheels 22 are used as an idler wheel for rotatably supporting the knife bands 18. Tow 28 is supplied from a source not shown and is wrapped around the periphery of the tow support 10 in surface contact with the knife band 18. Rotation of the knive bands 18 causes the tow 28 to be cut by orthogonal non-radial motion of the knife bands with respect to the direction of winding of the tow 28 on the tow support 10. The knife bands 18 do not dull rapidly because the tow 28 is stationary with respect to a direction orthogonal to the direction of movement of the cutting edges of the knife bands. Moreover, only light cutting pressure is required because of the orthogonal movement of the band knives 28. This pressure is regulatable by tensioning the tow 28. No additional pressure roller is required. The innermost layer of tow 28 wound around the tow support 10 is cut continuously by the pressure of the outer layers of the tow pushing the innermost layer radially inward against the knife bands 18. The pieces of staple are aspirated away from the cutting area of the knife bands 18 by means of pneumatic conveyor 30 which has a suction channel 32. The rotatable tow support 10 is driven by a shaft 34 which is journaled within housing 36 concentrically with the center of stationary ring gear 26. The shaft 34 is driven by a drive mechanism 38 which is comprised of pulley 40 and V-belts 42.

Figure 3:
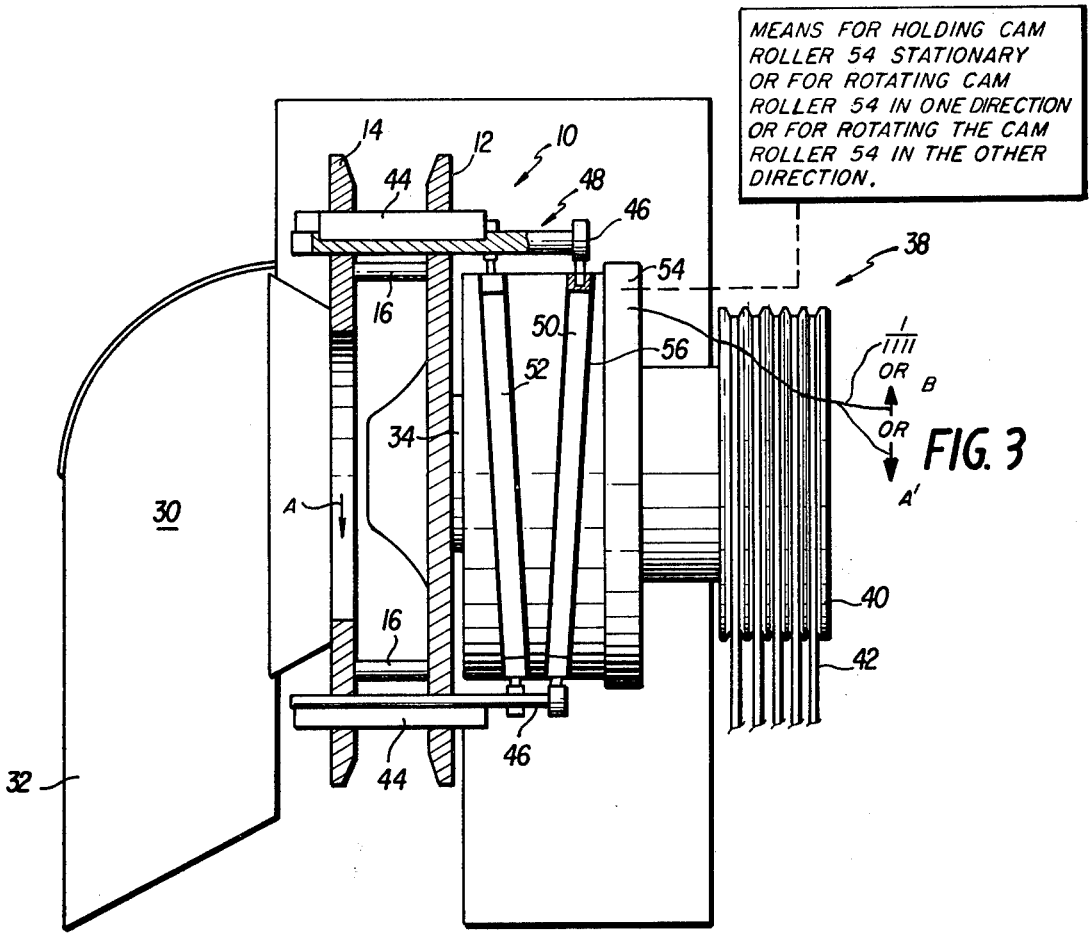
FIG. 3 is a side sectional view of the second embodiment of the present invention.
Figure 4:
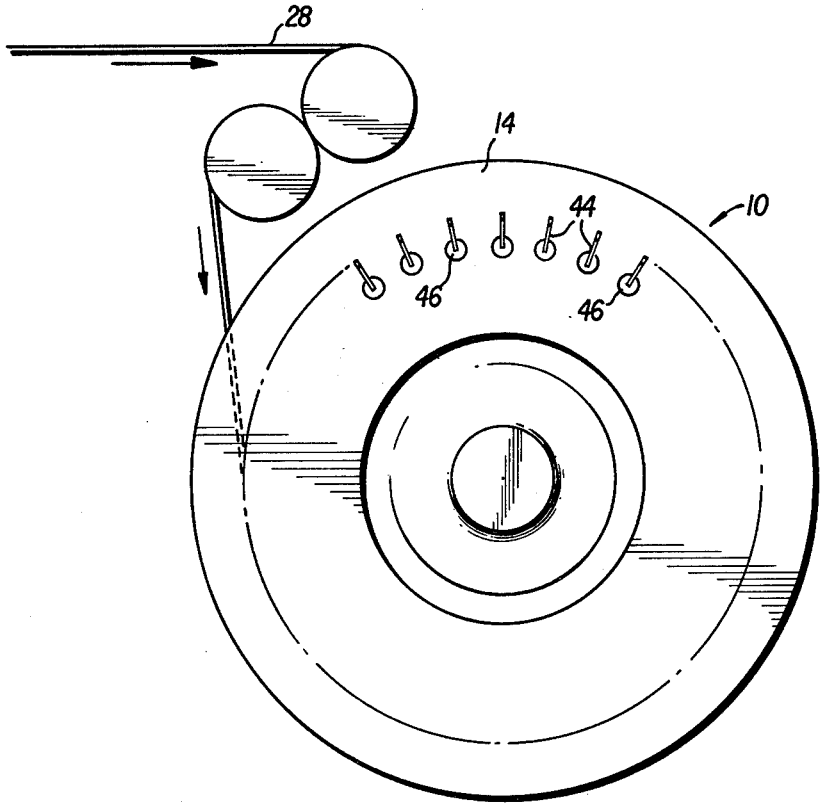
FIG. 4 is an end view of the second embodiment of the present invention.

FIGS. 3 and 4 illustrate a second embodiment of a tow cutting apparatus constructed according to the present invention. The tow cutting apparatus of FIGS. 3 and 4 differs from the tow cutting apparatus of FIGS. 1 and 2 with respect to the mechanism used for producing orthogonal movement of the cutting surfaces with respect to the tow. Identical parts in FIGS. 1, 2, 3 and 4 are identified by identical reference numerals. A plurality of cutting knives 44 are disposed around the outside of the textile support 10 so that their cutting surfaces project radially outward. The cutting knives 44 are fixedly mounted within slotted cylindrical rods 46 by retaining rings not shown. Replacement of the knives 44 is accomplished by removing the retaining ring: sliding the old knife out of the slotted cylinder, inserting a new knife within the slotted cylinder and attaching the retaining ring. The slotted cylindrical rods 46 are slideably mounted within the disk 12 and ring 14 of tow support 10 to permit reciprocal movement of the knives 44. A reciprocating mechanism 48 comprising a pair of cams 50 and 52 mounted in cam roller 54 and associated cam followers 56 which are coupled to the cutting knives 44 by the slotted cylindrical rods 46 produces reciprocation of the knives 44 orthogonal to the direction of winding of tow 28 on tow support 10 in surface contact with the knives. The lift of cam 50 in a direction parallel to the axis of rotation of the tow support 10 produces reciprocal motion of knives 44 coupled thereto in a first direction. The lift of cam 52 in a direction parallel to the axis of rotation of the tow support 10 produces reciprocal motion of knives 44 coupled thereto in a second direction which is opposite to the first direction. Preferably, every other knife 44 is coupled to the same direction. The tension increase of the tow 28 caused by opposite direction non-radial movement of adjacent blades improves cutting. The cut staple is aspirated inwardly away from the cutting knives 44 through the free spaces between the knives and off through suction channel 32 of pneumatic conveyor 30. The cam roller 54 is preferably stationary as indicated by the conventional symbol and is mounted concentrically with respect to rotatable shaft 34. However, the reciprocating speed of the knives 44 may be increased by rotating the cam roller 54 in a direction B opposite to the direction A of rotation of the tow support 10 instead of increasing the lift of the cams 48 and 50. Similarly, the reciprocating speed of the knives 44 may be decreased by rotating the cam roller 54 in the same direction A as the direction of rotation of the tow support 10 instead of decreasing the lift of cams 48 and 50. In this embodiment, cutting tow into a distribution of lengths requires changing the entire tow support 10 including the spacing between the knives 44.

The guides for the blades 44 and the slotted cylindrical rods 46 are designed so that a very small clearance exists between them and disk 12 and ring 14 to prevent the ingress and detention of fibers therein. Moreover, the guides must be manufactured from materials having a low coefficient of friction not requiring lubrication to prevent seizing between the guides and the knives 44 and slotted cylindrical rods 46.

In each of the embodiments of the invention, the draw cut of the tow 28 by the orthogonal motion of the cutting surfaces of the knife bands 18 or knives 44 with respect to the direction of winding of the tow 28 on the support 10 has considerable advantages. The uniformity of the staple length has been found to be considerably better than all heretofore known cutting machines. Moreover, because of the increased blade life caused by low blade velocity and low cutting pressures, fusing of filaments does not occur as a result of high frictional forces between the tow 28 and knife bands 18 and knives 44. Furthermore, multiple length fibers only occur in the present invention after the individual knives have become notched which occurs only after much longer operating times than in prior art tow cutting apparatus.

Figure 5A:
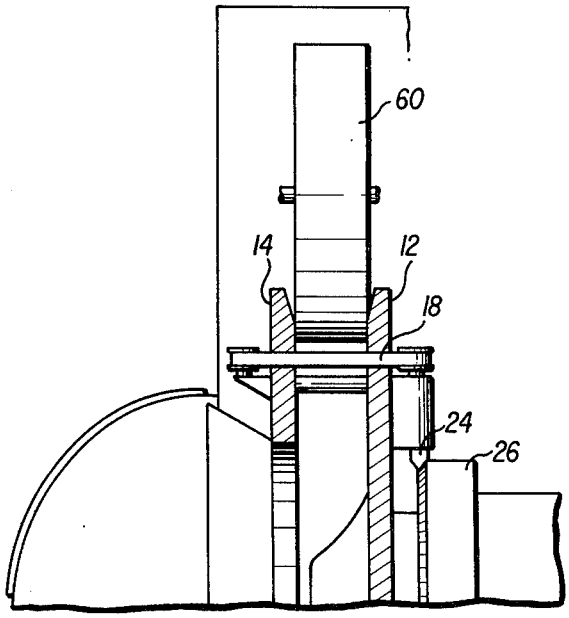
FIGS. 5*a* and 5*b* are respective side and end views of an apparatus which may be used in the first and second embodiments of the invention for detecting when the knives or knife bands have become too dull to cut tow wound on the tow support.
Figure 5B:
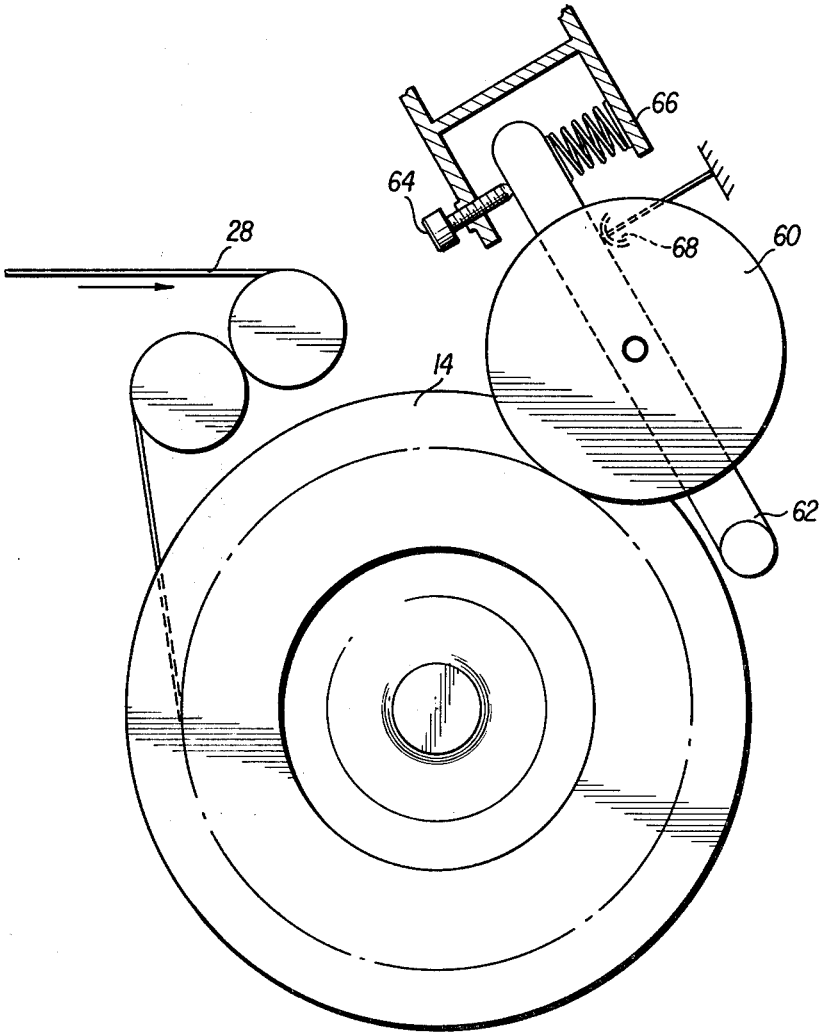

FIGS. 5*a* and 5*b* illustrate an apparatus for detecting when the knife bands 18 and the knives 44 of the first and second embodiments have become too dull to continue to cut tow 28. A roller 60 is mounted in close proximity to the tow support 10 in a pivoted support 62. The distance between the roller 60 and the tow support 10 is adjustable by a set screw 64. A spring 66 biases the roller 60 against the set screw 64 so that the spring is compressed when the roller is moved away from the tow support 10. The biasing of the roller 60 against the tow support 10 by spring 64 permits knots and thick pieces of tow 28 to pass without closing a switch 68. However, as soon as the cutting surfaces fail to cut tow 28, the thickness of the layers of tow wound on support 28 builds up to a point where switch 66 opens causing a source of power to be disconnected from an electric motor not shown to stop rotation of the two support 10.

The two embodiments of the present invention may be used to cut tow having a multiple length distribution. To cut tow in a multiple length distribution, the spacing between successive cutting surfaces may be incrementally increased or adjacent cutting surfaces may be oriented in a nonparallel orientation with respect to each other.

Figure 6:
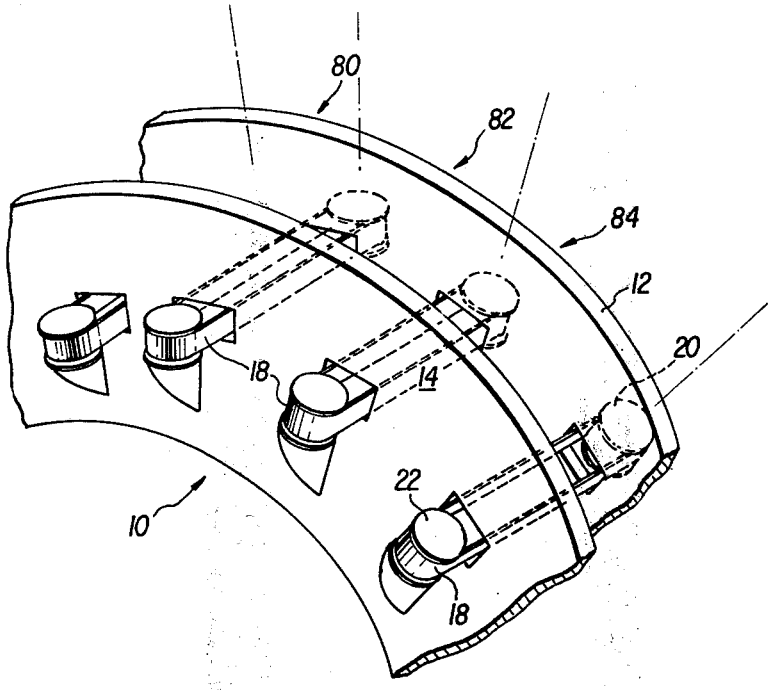
FIG. 6 is a partial perspective of a modified orientation of the knife bands illustrated in FIGS. 1 and 2.

FIG. 6 illustrates an orientation of the knife bands 18 used for cutting staple having a multiple length distribution in the first embodiment of the invention. The band wheels 20 of the disk 12 and the band wheels 22 of the ring 14 are spaced around the circumference of the tow support 10 at increasing space intervals 80, 82 and 84, etc.

Figure 7:
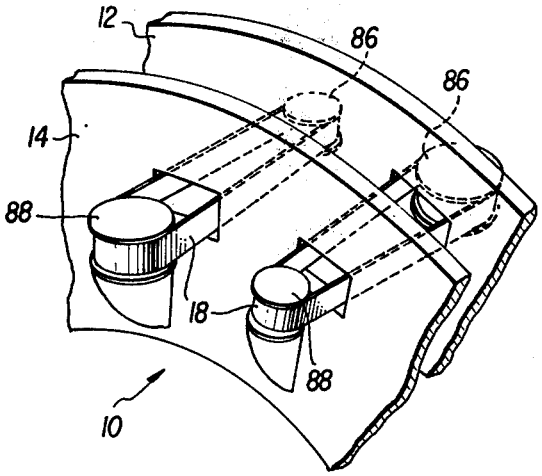
FIG. 7 is a partial perspective of another modified orientation of the knife bands illustrated in FIGS. 1 and 2.

FIG. 7 illustrates an orientation of the knife bands 18 used for cutting staple having two lengths in the first embodiment of the invention. In this orientation, the band wheels 86 associated with the disk 12 and the band wheels 88 associated with the ring 14 are of two different diameters which are alternated around the circumference of the disk 12 and ring 14 so that adjacent cutting surfaces of the band knives 18 are in a nonparallel orientation with respect to each other. It is within the scope of the invention to use band wheels 86 and 88 having more than two diameters to cut tow into more than two lengths. The nonparallel orientation of the cutting surfaces of knife bands 18 produces transverse movement of the cutting surfaces with respect to the direction of winding of the tow on the tow support 10.

Figure 8:
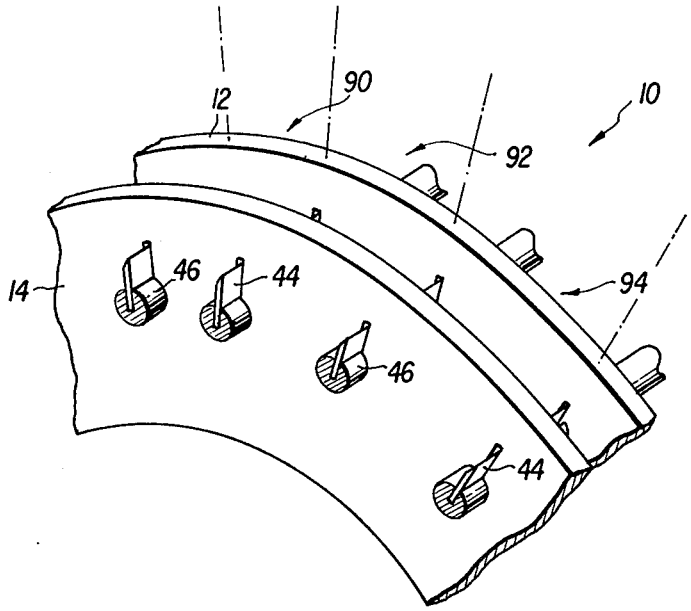
FIG. 8 is a partial perspective of a modified orientation of the knives illustrated in FIGS. 3 and 4.

FIG. 8 illustrates an orientation of the blades 44 used for cutting staple having a multiple length distribution in the second embodiment of the invention. In this orientation, the individual blades are spaced about the circumference of the disk 12 and ring 14 at increasing space intervals 90, 92 and 94 etc.

Figure 9:
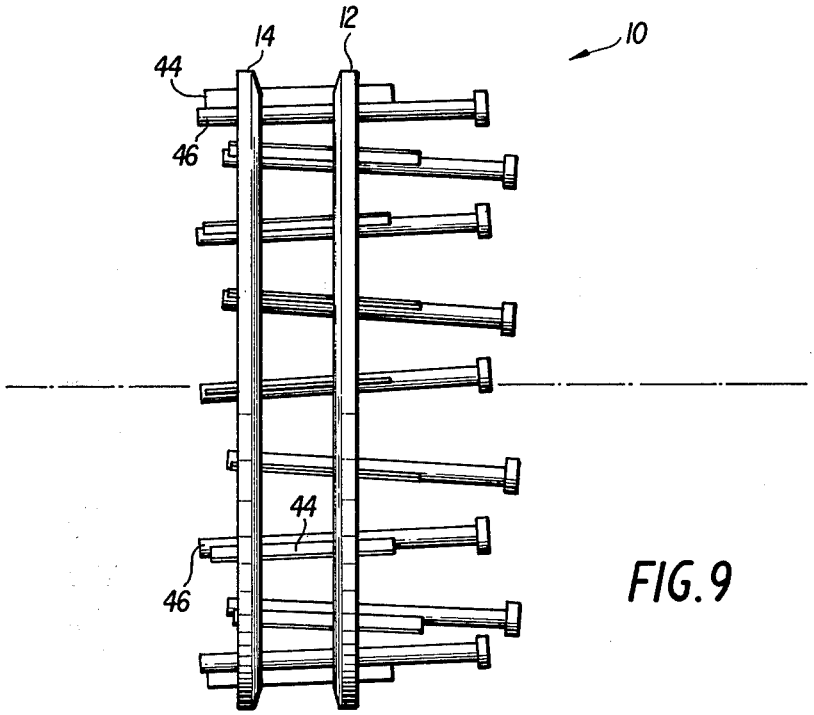
FIG. 9 is a partial perspective of another modified orientation of the knives illustrated in FIGS. 3 and 4.

FIG. 9 illustrates an orientation of the knives 44 used for cutting staple having two lengths in the second embodiment of the invention. In this orientation, adjacent knives 44 are mounted in a nonparallel orientation with respect to each other in the disk 12 and ring 14 so that they reciprocate noncoaxially with the axis of rotation of the tow support 10. The nonparallel orientation of the blades 44 produces transverse movement of the cutting surfaces with respect to the direction of winding of the tow 28 on the tow support 10.

Staple having a length distribution which has been produced by the cutting surface orientation of FIGS. 6 through 9 produce superior products when combined with natural fibers. The superior products result from the close correlation between the length distribution of the staple and the length distribution of the natural fibers.

While the invention has been described in terms of two embodiments and modifications thereof, it should be apparent to those skilled in the art that other modifications may be made to the invention without departing from its spirit and scope. Accordingly, it is intended that all possible modifications fall within the scope of the appended claims.

What is claimed is:

1. A process for cutting textile tow into staple comprising the steps of:

(a) winding a strand of textile tow upon a rotating textile tow support demarcating an interior in a direction generally parallel to the direction of rotation of said support to form an inner layer of tow wrapped on said tow support and one or more outer layers of tow wrapped on top of said inner layer, said tow being under tension to cause an inward pressure to be exerted solely by said tow against said tow support;

(b) cutting said strand of textile tow into staple with a plurality of cutting surfaces which face radially outward and which contact the innermost layer of tow, by non-radial movement of each of said cutting surfaces transversely to said direction of winding of said tow upon said support and by an opposite non-radial transverse movement of the next adjacent cutting surface to increase tension on the tow between said adjacent cutting surfaces, thereby to improve cutting and cut the tow into pieces of staple; and (c) removing said staple from the interior of said tow support and away from said cutting surfaces.

2. A process as recited in claim 1 wherein:

(a) said pieces of staple are cut by pairs of adjacently disposed cutting surfaces; and (b) one of each said pair of cutting surfaces moves non-radially in a first direction transverse to the direction of winding of said tow on said tow support and the other of the same said pair of cutting surfaces moves in a non-radial direction parallel to and opposite to the direction of motion of said one cutting surface.

3. A process as recited in claim 1, said step of removing said staple comprising aspirating said staple inward toward the center interior of said tow support.

4. A process for cutting textile tow into staple comprising the steps of:

(a) winding a strand of textile tow upon a rotating textile tow support demarcating an interior in a direction generally parallel to the direction of rotation of said support to form an inner layer of tow wrapped on said tow support and one or more outer layers of tow wrapped on top of said inner layer, said tow being under tension to cause an inward pressure to be exerted solely by said tow tension against said tow support;

(b) cutting said strand of textile tow into staple with a plurality of cutting surfaces which face radially outward and which contact the innermost layer of tow, by non-radial movement of each of said cutting surfaces transversely to said direction of winding of said tow upon said support and by an opposite non-radial transverse movement of the next adjacent cutting surface to increase tension on the tow between said adjacent cutting surfaces, thereby, to improve cutting and cut the tow into pieces of staple;

(c) removing said staple from the interior of said tow support and away from said cutting surfaces, said tow support comprising said plurality of cutting surfaces, and said cutting surfaces providing the sole support for the tow wrapped on the support.

5. A process as recited in claim 4 wherein:

the transverse non-radial movement of said cutting surfaces is orthogonal to said direction of winding of said tow upon said support.

6. A process as recited in claim 4 wherein:

(a) said pieces of staple are cut by pairs of adjacently disposed cutting surfaces; and (b) one of each said pair of cutting surfaces moves non-radially in a first direction transverse to the direction of winding of said tow on said tow support and the other of said pair of cutting surfaces moves non-radially in a direction parallel to and opposite to the direction of motion of said one cutting surface.

7. An apparatus for cutting textile tow into staple comprising:

(a) a rotatable tow support demarcating an interior which is adapted to have a strand of tow wound thereon to form an inner layer in surface contact with said tow support and one or more outer layers wrapped on top of said inner layer in a direction generally parallel to the direction of rotation of said support;

(b) means for rotating said support about an axis;

(c) tow feeding means for feeding a strand of tow to said rotatable support to form said layers under tension to cause said tow to exert solely by said tension an inward pressure against said tow support;

(d) said support including a plurality of cutting surfaces facing radially outward, said cutting surfaces being in surface contact with said inner layer of tow wound on said support;

(e) means for non-radially moving during rotation of said support one of said cutting surfaces in a direction transverse to the direction of winding of said tow on said support and the adjacent one of said cutting surfaces in a non-radial direction opposite said first direction, said transverse moving means thereby increasing the tension on tow between said adjacent surfaces, whereby cutting action is improved and the tow cut into staple; and (f) means for removing said staple from the interior of said tow support and away from said cutting surfaces.

8. A tow cutting apparatus as recited in claim 7, said means for removing said staple comprising means for aspirating said tow toward the interior of said tow support.

9. A tow cutting apparatus as recited in claim 7 wherein said means for non-radially moving said cutting surfaces moves said cutting surfaces orthogonal to the direction of winding said tow on said support.

10. A tow cutting apparatus as recited in claim 7 wherein:

(a) said plurality of cutting surfaces comprise band knives rotatably mounted around the periphery of said support; and (b) said means for non-radially moving said cutting surfaces comprises first and second band wheels rotatably supporting each of said knife bands, said band wheels being mounted on said support and a gear drive coupled to said band wheels for rotating said band wheels upon rotation of said support.

11. A tow cutting apparatus as recited in claim 10 wherein said support further comprises:

(a) a disk coupled to said means for rotating said support;

(b) a ring connected to said disk by a plurality of members; and (c) where said bank knives are rotatably supported in said disk by said first band wheels and in said ring by said second band wheels.

12. A tow cutting apparatus as recited in claim 11 wherein:

(a) said band knives are evenly spaced around the periphery of said support; and (b) the diameter of said band wheels is equal to the space between adjacent band knives.

13. A tow cutting apparatus as recited in claim 12 wherein:

(a) said first band wheels have at least first and second diameters;

(b) said second band wheels also have at least first and second diameters;

(c) said first band wheels are disposed in a distribution around the periphery of said disk; and (d) said second band wheels are disposed in a distribution around the periphery of said ring.

14. A tow cutting apparatus as recited in claim 13 wherein:

(a) said distribution of said first band wheels around the periphery of said disk comprises an alternation of said first band wheel first and second diameters; and (b) said distribution of said second band wheels around the periphery of said ring comprises and alternation of said second band wheel first and second diameters.

15. A tow cutting apparatus as recited in claim 11 wherein said band knives are unevenly spaced around the periphery of said support.

16. A tow cutting apparatus as recited in claim 10 wherein said gear drie comprises:

(a) a stationary ring gear mounted coaxial with the axis of rotation of said support; and (a) a rotatable gear coupled to each of said first band driving wheels and to said stationary gear.

17. An apparatus for cutting textile tow into staple comprising: (a) a rotatable tow support which demarcates an interior and is adapted to have a strand of tow wound thereon to form an inner layer in surface contact with said tow support and one or more outer layers wrapped on top of said inner layer in a direction generally parallel to the direction of rotation of said support;

(b) means for rotating said support about an axis;

(c) tow feeding means for feeding a strand of tow to said rotatable support to form said layers under tension to cause said tow to exert solely by paid tension an inward pressure against said tow support;

(d) said support including a plurality of cutting surfaces facing radially outward, said cutting surfaces providing the sole support for said layers of tow and being in surface contact with said inner layer of tow wound on said support;

(e) means for non-radially moving during rotation of said support each of said cutting surfaces in a direction transverse to the direction of winding of said tow on said support and the adjacent ones of said cutting surfaces in a non-radial direction opposite said first direction, said transverse moving means thereby increasing the tension on tow between said adjacent surfaces, whereby cutting action is improved and the tow cut into staple (f) means for removing said staple from the interior of said tow support and away from said cutting surfaces.

18. A tow cutting apparatus as recited in claim 17 wherein:

(a) said tow support comprises a plurality of knives which are slideably mounted, said knives having said cutting surfaces; and (b) said means for non-radially moving said cutting surfaces comprises means for reciprocating said knives during rotation of said tow support.

19. A tow cutting apparatus as recited in claim 18 further comprising:

(a) a disk coupled to said means for rotating said support;

(b) a ring coupled to said disk by a plurality of members;

(c) a slotted cylindrical member secured to each of said knives, each of said members being slideably mounted within said disk and ring to permit transverse movement of said knives.

20. A tow cutting apparatus as recited in claim 18 wherein said reciprocating means comprises:

(a) a first cam having a surface coupled to every other one of said slotted members, said cam surface having a lift in a direction parallel to the axis of rotation of said support to cause said members coupled thereto to move in a first direction transverse to said direction of winding of said tow of said support, and;

(b) a second cam having a surface coupled to the remaining slotted members not coupled to said first cam, said second cam having a lift in a direction parallel to the axis of rotation of said support to cause said members coupled thereto to move in a second direction transverse to said direction of winding of said tow on said support, said second direction being opposite to the direction of motion of the members coupled to said first cam surface.

21. A tow cutting apparatus as recited in claim 20 wherein said knives are evenly spaced from each other.

22. A tow cutting apparatus as recited in claim 20 comprising means to hold said first and second cams stationary when said support is moving.

23. A tow cutting apparatus as recited in claim 20 comprising means to rotate said cams coaxially with the axis of rotation of said support during rotation of said support.

24. A tow cutting apparatus as recited in claim 20 wherein said knives are unevenly spaced from each other.

25. A tow cutting apparatus as recited in claim 20 wherein said knives reciprocate orthogonal to said direction of winding of said tow on said support.

* * * * *

UNITED STATES PATENT OFFICE

CERTIFICATE OF CORRECTION

Patent No. 4,141,115 Dated 2/27/79

Inventor(s) Franz Fourne and Ursula Fourne

It is certified that error appears in the above-identified patent and that said Letters Patent are hereby corrected as shown below:

Column 1, line 26 change "two" to --tow--.
Column 1, line 54 before "cut" insert --is--.
Column 2, line 64, change "two" to --tow--.
Column 5, line 2, change "A" to --A'--.
Column 8, line 15, "tow", first occurrence, to -- staple --
Column 8, line 39 (line 7 of claim 11), change "bank" to --band--.
Column 9, line 5, change "drie" to --drive--.
Column 9, line 20 (by count) that is, line 11 of claim 17, change "paid" to --said--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*